United States Patent [19]

Szabó née Mogyorossi et al.

[11] Patent Number: 4,859,209

[45] Date of Patent: Aug. 22, 1989

[54] STABLE BROWN-COAL/OIL SUSPENSIONS AND A PROCESS FOR PREPARING SAME

[75] Inventors: Katalin Szabó née Mogyorossi; István Kalocsai; Istyán Gyóni, all of Tatabánya; Károly Reményi, Budapest; György Pláveczky, Százhalombatta; László Kovács, Budapest; Dezsö Gál, Budapest; István Nemes, Budapest; László Botár, Budapest; Ákos Bencsura, Kecskemét; Galina Móger née Jeremejeva, Budapest; Károly Héberger, Budapest; András Németh, Budapest, all of Hungary

[73] Assignee: MTA Kozponti Kemiai Kutato Intezet, Budapest, Hungary

[21] Appl. No.: 5,952

[22] Filed: Jan. 22, 1987

[30] Foreign Application Priority Data

Jan. 22, 1986 [HU] Hungary ..... 297/86

[51] Int. Cl.[4] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 1,382,457 | 6/1921 | Bates | 44/51 |
| 4,082,516 | 4/1978 | Metzger | 44/51 |
| 4,138,226 | 2/1979 | Verschuur | 44/51 |
| 4,149,855 | 4/1979 | Kohn et al. | 44/51 |
| 4,153,421 | 5/1979 | Marlin | 44/51 |
| 4,392,940 | 7/1983 | Tao | 44/51 |
| 4,472,170 | 9/1984 | Hellyer | 44/51 |
| 4,475,924 | 9/1984 | Meyer | 44/51 |
| 4,502,868 | 3/1985 | Yaghmaie et al. | 44/51 |
| 4,610,695 | 9/1986 | Crespin et al. | 44/51 |
| 4,637,822 | 1/1987 | Niu et al. | 44/51 |

*Primary Examiner*—William R. Dixon, Jr.
*Assistant Examiner*—Margaret B. Medley
*Attorney, Agent, or Firm*—Keil & Weinkauf

[57] ABSTRACT

The invention relates to stable brown-coal/oil suspensions and a process for preparing same. The suspension contains 20 to 60% by mass of coal powder and 40 to 80% by mass of fuel oil of 25 to 70% by mass of an agglomerate and 30 to 75% by mass of fuel oil.

The invention renders possible to utilize brown-coal powders of low value for heating purposes.

3 Claims, No Drawings

STABLE BROWN-COAL/OIL SUSPENSIONS AND A PROCESS FOR PREPARING SAME

The invention relates to stable coal/oil suspensions and to a process for the preparation thereof.

Owing to the recent shortage in energy all over the world, research works directed to the utilization of coal resources, particularly brown coals of lower quality, came into prominence. Several methods have been disclosed in which coal powders or aqueous coal suspensions are applied as starting substances for the production of fuel materials. By these methods not only practically useless coals of low quality are converted into valuable fuel materials, but the increasingly severe demands of environmental protection are fulfilled as well, since wastes are processed thereby.

When processing coal powders, generally mineral oil derivatives are applied as binding agents. Obviously, these substances increase the caloric value of the coal materials processed. Problems arise, however, from the fact that the products frequently do not possess the required stability. In order to solve this problem the use of various stabilizing additives has been suggested.

Thus, according to U.S. Pat. No. 4,153,421 a suspension of appropriate quality is prepared by adding coal powder to an emulsion consisting of fuel oil, water and an emulsifying agent. Dextrin or peptized starch is utilized as emulsifying agent. Utilizing these substances, not only a homogeneous suspension can be prepared but its stability is secured as well.

According to German Pat. No. 2,942,122 coke, brown coal, bitumenous coal, anthracite or bitumen is applied as solid component, which is suspended, in the presence of emulsifying agents, in various hydrocarbon fractions, tar, tar oil or mixtures thereof. Salts of mono- or diethanolamine or mono- or diisopropylamine formed with $C_{12-18}$ carboxylic acids are applied as emulsifying agents.

According to U.S. patent specification No. 4,162,143 an aqueous coal suspension is prepared utilizing a specific emulsifying mixture which comprises as surfactant a condensate of cycloalkyl phenol with an aldehyde or a polyamine. It is mentioned as an advantage of this process that nitrogen oxides which are formed in the burning process are reduced in the burning apparatus upon the effect of water present in the suspension, thus environmental pollution decreases to some extent upon the use of this material.

Several additives have been suggested to stabilize coal suspensions, too, of which polyethylene glycol derivatives are the most widespread. Thus, e.g. polyethylene glycol mono- and dinonyl phenyl ethers (published Japanese patent application No. 55-101,006), polyethylene glycol ether sulfate (published Japanese patent application No. 54-65,709) and polyethylene glycol lauryl ether (published Japanese patent application No. 54-149,390) have been used. The use of various amino compounds, such as lauryl amine naphthenate (published Japanese patent application No. 55-94,995) has also been suggested. All of these methods have the disadvantage that the substances which are used to prepare and stabilize coal suspensions are sophisticated in structure, relatively difficult to prepare and expensive.

The invention aims at producing stable suspensions from fuel oil and brown coal powders of low quality and caloric value either without any stabilizing agent or by utilizing inexpensive wastes as stabilizing substances.

Brown-coal powders of varying origin and processing grade have been tested and it has been found that a substance prepared by inverse agglomeration technique is the most suitable for the production of stable suspensions. As it appears from our published Hungarian patent application No. 4771/84, a fuel oil dispersion is formed at 20° C. from coal washings separated from very fine dead rock, thereafter further coal washings are added to the dispersion in several steps, and dead rock is separated. Now it has been observed that when this agglomerate is admixed with further amounts of fuel oil, a very stable suspension is formed, even in the absence of any surfactant, which is practically not subject to aggregation. Thus, in connection with the stability of the suspension only sedimentation is to be considered and, if necessary, sedimentation is impeded with appropriate additives. It has also been observed that sedimentation can be completely excluded when for example less wastes formed in olefine epoxidation processes or in toluene oxidation are added to the oily suspension. Wastes formed in the polymerization of various acryl monomers exert appropriate stabilizing effect as well; furthermore wastes formed in the oxidation of olefines and wastes of starch production can also be applied as stabilizing agents.

Now it has been found that stable suspensions can be prepared from 20 to 60% by mass of coal powder or 25 to 70% by mass of an agglomerate comprising 65 to 80% by mass of brown coal powder, 8 to 18% by mass of fuel or heating oil and 10 to 18% by mass of water, 30 to 80% by mass of fuel oil, and optionally 0.2 to 10% by mass of a stabilizer.

Accordingly, the invention relates to a stable brown coal/oil suspension containing (a) 20 to 60% by mass of coal powder or 25 to 70% by mass of an agglomerate which comprises 65 to 80% by mass of brown-coal powder, 8 to 18% by mass of fuel oil or heating oil with a solidification point above 20° C. and 10 to 18% by mass of water, and (b) 40 to 80% by mass of fuel oil in case of coal powder or 30 to 75% by mass of fuel oil in case of agglomerate, respectively.

The suspension may contain, if desired, 0.2 to 10% by mass of a stabilizer.

The agglomerate comprises preferably 70 to 80% by mass of brown-coal powder, 10 to 14% by mass of fuel or heating oil and 12 to 15% by mass of water.

The suspension can be formed in different ways. Appropriate results can be obtained even upon simple mechanical mixing at a temperature exceeding room temperature, e.g. at 65°–75° C. The suspension can also be prepared by direct steam injection, in which case it is sufficient to preheat the slurry to 50° C. before injection. Suspensions of very good quality can also be obtained when mixing is effected in several stages and the substance is allowed to stand and cool after each of the individual steps.

Examination of sedimentation stability with rotation viscosity measurement proved to be the most appropriate to qualify the suspensions produced. The viscosity of sulfur-containing light fuel oil No. F 60/130, utilized in the preparation of the suspension, was measured first at 50° C. and 70° C.; the measured values were $520\times10^{-6}$ m$^2$/sec and $140\times10^{-6}$ m$^2$/sec, respectively. Thereafter a suspension of 50% dry substance content was prepared from this oil. The viscosity of the suspension, measured at 70° C. immediately after clarification, was $220\times10^{-5}$ m²/sec. The suspension was maintained at 70° C. for 4 weeks, and then viscosity was measured again. A value of $280\times10^{-5}$m²/sec was obtained, which indicates that the mixture is practically stable. When the suspension prepared and handled as described above it stirred even gently, its viscosity decreases to the original value. Considering that the viscosity observed is above the solidification point of the oil free of additive, the suspension can be handled in the same was as the starting fuel oil, i.e. the suspension can be transported in pipelines and burnt in oilheated boilers without any difficulty.

The main advantages of the coal/oil suspensions according to the invention and of the process for preparing same are as follows:

(a) For preparing coal-oil suspensions by-products of mine-working and coal-treating can be utilized which, owing to their high moisture and ash contents, could not be economically utilized for producing energy.

(b) In the claimed process, the extraction of the coal content and the reduction of the ash content of coal slime of high ash content, as well as the preparation of a stable coal-oil suspension, are carried out in a single step.

(c) In the process, enrichment of extremely high degree can be attained and the coal content of the final gangue slime can be reduced to a minimum value.

(d) Depending on the age of the utilized coal and the quality of the incidental gangue, the use of a stabilizing additive may be unnecessary or the required stability may be ensured with the aid of compounds of low quantity and of by-product character.

(e) The coal sorts to be worked up with the claimed process range to all coal sorts being older than lignite, that is they range from the young brown-coals to the black coals.

The invention is elucidated in detail by the aid of the following non-limiting Examples.

EXAMPLE 1

0.6 kg of an agglomerate consisting of 10% by weight of F 60/130 sulfur-containing light fuel oil, 15% by weight of water and 75% by weight of coal powder of Felsogalla (Hungary) origin (particle size: below 0.2 mm) is admixed with 0.4 kg of F 60/130 sulfur-containing light fuel oil of a temperature of 70° C., and the mixture is stirred in a knife mixer at a speed of 2000 r.p.m. for 5 minutes. The resulting suspension is stable for more than 2 months.

EXAMPLE 2

0.3 kg of an agglomerate with the composition disclosed in Example 1 is admixed at 70° C. with 0.7 kg of F 60/130 sulfur-containing light fuel oil, and 0.25 kg of a distillation residue obtained in propylene epoxidation process is added to the mixture as stabilizing agent. Stirring is performed as described in Example 1.

EXAMPLE 3

0.4 kg of an agglomerate with the composition disclosed in Example 1 is admixed with 0.6 kg of light fuel oil and 10 g of a waste of low protein content obtained as residue in the processing of starch. The 10 g of waste is swollen in 100 ml of water prior to admixing. Otherwise one proceeds as described in Example 1.

EXAMPLE 4

0.65 kg of a fuel oil described above is heated to 50° C. 0.3 kg of an agglomerate as disclosed in Example 1 of 0.1 kg of a stabilizing agent are sprayed into the fuel oil with steam at a pressure of 2 atmospheres. The stabilizer applied is a substance obtained by washing with alkali a distillation residue formed in the low temperature oxidative decomposition of brown-coal.

What we claim is:

1. A process for the preparation of a stable brown coal/oil suspension, consisting essentially of mechanically admixing:

(a) 25 to 70% by mass of an agglomerate comprising 65 to 80% by mass brown coal powder, 10 to 18% by mass of a fuel oil or heating oil with a solidification point above 20° C. and 10 to 17% by mass of water, and (b) 30 to 75% by mass of fuel oil, at a temperature of 65°–75° C.

2. A process as defined in claim 1, in which the admixture of the components is carried out in at least 2 stages.

3. A process for the preparation of a stable brown coal/oil suspension consisting essentially of admixing by steam injection:

(a) 25 to 70% by mass of an agglomerate comprising 65 to 80% by mass of brown coal powder, 10 to 18% by mass of fuel oil or heating oil with a solidification point above 20° C. and 10 to 17% by mass of water, with (b) 30 to 75% by mass of fuel oil, wherein the fuel oil b) is preheated to 50° C. before injection.

* * * * *